US008656852B1

(12) United States Patent
Jones et al.

(10) Patent No.: US 8,656,852 B1
(45) Date of Patent: Feb. 25, 2014

(54) HIDEAWAY HELM FOR WATERCRAFT

(71) Applicants: Bartley D. Jones, Mound, MN (US); Steven R. Hendirckson, Burnsville, MN (US)

(72) Inventors: Bartley D. Jones, Mound, MN (US); Steven R. Hendirckson, Burnsville, MN (US)

( * ) Notice: Subject to any disclaimer, the term of this patent is extended or adjusted under 35 U.S.C. 154(b) by 0 days.

(21) Appl. No.: 13/743,405

(22) Filed: Jan. 17, 2013

Related U.S. Application Data

(60) Provisional application No. 61/588,845, filed on Jan. 20, 2012.

(51) Int. Cl.
*B63B 35/73* (2006.01)

(52) U.S. Cl.
USPC ..... 114/55.52; 114/144 R

(58) Field of Classification Search
USPC ..... 114/144 R, 55.52
See application file for complete search history.

(56) References Cited

U.S. PATENT DOCUMENTS

| | | | | |
|---|---|---|---|---|
| 4,014,283 | A | 3/1977 | Cmogorac | |
| 4,941,421 | A * | 7/1990 | Anderson | 114/144 R |
| 5,282,437 | A * | 2/1994 | Avillez de Basto | 114/345 |
| 5,377,609 | A * | 1/1995 | Miller | 114/144 R |
| 5,465,679 | A | 11/1995 | Mardikian | |
| 5,542,862 | A * | 8/1996 | Kobayashi | 440/38 |
| 5,626,501 | A | 5/1997 | He | |
| 5,970,898 | A | 10/1999 | Pereira | |
| 6,062,154 | A | 5/2000 | Ito | |
| 6,083,062 | A | 7/2000 | Treloar et al. | |
| 6,276,291 | B1 | 8/2001 | Lapointe et al. | |
| 6,477,976 | B2 | 11/2002 | Van Gelder | |
| 6,684,803 | B1 | 2/2004 | Dickson | |
| 6,729,647 | B2 | 5/2004 | Shapior et al. | |
| 6,729,674 | B2 | 5/2004 | Davis et al. | |
| 6,929,278 | B2 | 8/2005 | Vaimacr | |
| 7,004,091 | B2 * | 2/2006 | Adamczyk et al. | 114/55.52 |
| 7,018,252 | B2 | 3/2006 | Simard et al. | |
| 7,150,662 | B1 | 12/2006 | Janitz | |
| 7,194,974 | B2 | 3/2007 | Kamio | |
| 7,341,013 | B2 * | 3/2008 | Yoshiki | 114/55.52 |
| 7,357,090 | B2 * | 4/2008 | Spade et al. | 114/55.52 |
| 7,793,980 | B2 | 9/2010 | Fong | |
| 7,887,381 | B2 | 2/2011 | Brass et al. | |
| 8,037,781 | B2 | 10/2011 | Curtin et al. | |
| 2002/0151232 | A1 | 10/2002 | Van Gelder | |
| 2008/0110290 | A1 | 5/2008 | Buettner | |
| 2009/0108576 | A1 | 4/2009 | Fong | |
| 2010/0295262 | A1 | 11/2010 | Teal et al. | |
| 2013/0186321 | A1 * | 7/2013 | Jones et al. | 114/144 R |

* cited by examiner

*Primary Examiner* — Stephen Avila
(74) *Attorney, Agent, or Firm* — Mitchell A. Rossman; Terra Nova Patent Law, PLLC

(57) ABSTRACT

The present invention provides a hide away helm for a watercraft that is positionable between a use position in which the hide away helm extends up from the deck and a non-use position in which the hide away helm retracts into a deck cavity and becomes flush with the deck. The hide away helm includes: a mounting member, a first support member, an optional biasing member, a steering device, one or more second support members, and a deck member.

11 Claims, 4 Drawing Sheets

HIDEAWAY HELM FOR WATERCRAFT

RELATED APPLICATIONS

This application claims priority to U.S. Provisional Patent Application Ser. No. 61/588,845 filed Jan. 20, 2012, which is hereby incorporated by reference in its entirety for all purposes.

BACKGROUND OF THE INVENTION

Many small watercrafts typically have a steering arrangement or helm that includes a steering wheel mounted to a dashboard, which is placed in the center of the interior space in the watercraft. As a consequence, the helm is mounted within the boat and takes up a large amount of space. Further, there are times, for example, being anchored at a fishing spot, where the helm is not required. However, it is generally not possible or convenient to remove the helm when not in use.

What is needed is a helm that may retract out of the boat space when not in use.

SUMMARY OF THE INVENTION

The present invention provides a hide away helm that extends into the interior space when the helm is in use but retracts under the deck when the helm is not in use. This hide away helm allows for the full use of the interior space of the boat when the helm is not in use, but is conveniently extends upward and into position in the interior of the boat before using. The hide away helm is simple to manufacture and install.

The present invention provides a hide away helm for a watercraft that is positionable between a use position in which the hide away helm extends up from the deck and a non-use position in which the hide away helm retracts into a deck cavity and becomes flush with the deck. The hide away helm includes: a mounting member having a proximal end and one or more distal ends, wherein the proximal end of the mounting member is coupled to the deck cavity; a first support member having a proximal end, a distal end, a first surface, and a second surface, wherein the proximal end of the first support member is coupled for pivot movement to the one or more distal ends of the mounting member; an optional biasing member having a proximal end and a distal end, wherein the proximal end of the optional biasing member is coupled to the mounting member and the distal end of the optional biasing member is coupled to the first support member, wherein the optional biasing member biases the hide away helm into the non-use position; a steering device operatively coupled to the first surface of the first support member; one or more second support members each having a proximal and a distal end, wherein each proximal end of the one or more second support members are each independently coupled for pivot movement to the distal end of the first support member, wherein each distal end of the one or more second support members are each independently coupled for pivot movement to a first side of a deck member having a first side, a second side, a proximal end, and a distal end, wherein the distal end of the deck member is coupled for pivot movement to the deck cavity or to the deck; and wherein the second side of the deck member becomes flush with the deck when the hide away helm is in the non-use position.

In one embodiment, the deck includes a cockpit. In one embodiment, the hide away helm extends into the cockpit when in the use position. In one embodiment, the steering device includes a steering wheel. In one embodiment, the optional biasing member includes a gas strut.

The present invention provides a hide away helm for a watercraft that is positionable between a use position in which the hide away helm extends up from the deck and a non-use position in which the hide away helm retracts into a deck cavity and becomes flush with the deck. The hide away helm includes: a mounting member having a proximal end and one or more distal ends, wherein the proximal end of the mounting member is coupled to the deck cavity; a first support member having a proximal end, a distal end, a first surface, and a second surface, wherein the proximal end of the first support member is coupled for pivot movement to the one or more distal ends of the mounting member; a biasing member having a proximal end and a distal end, wherein the proximal end of the biasing member is coupled to the mounting member and the distal end of the biasing member is coupled to the first support member, wherein the biasing member biases the hide away helm into the non-use position; a steering device operatively coupled to the first surface of the first support member; two second support members each having a proximal and a distal end, wherein each proximal end of the two second support members are each independently coupled for pivot movement to the distal end of the first support member, wherein each distal end of the two second support members are each independently coupled for pivot movement to a first side of a deck member having a first side, a second side, a proximal end, and a distal end, wherein the distal end of the deck member is coupled for pivot movement to the deck cavity or to the deck; and wherein the second side of the deck member becomes flush with the deck when the hide away helm is in the non-use position.

The present invention provides a hide away helm for a watercraft that is positionable between a use position in which the hide away helm extends up from the deck and a non-use position in which the hide away helm retracts into a deck cavity and becomes flush with the deck. The hide away helm includes: a mounting member having a proximal end and one or more distal ends, wherein the proximal end of the mounting member is coupled to the deck cavity; a first support member having a proximal end, a distal end, a first surface, and a second surface, wherein the proximal end of the first support member is coupled for pivot movement to the one or more distal ends of the mounting member; a biasing member having a proximal end and a distal end, wherein the proximal end of the biasing member is coupled to the mounting member and the distal end of the biasing member is coupled to the first support member, wherein the biasing member includes a gas strut, wherein the biasing member biases the hide away helm into the non-use position; a steering device operatively coupled to the first surface of the first support member, wherein the steering device includes a steering wheel; two second support members each having a proximal and a distal end, wherein each proximal end of the two second support members are each independently coupled for pivot movement to the distal end of the first support member, wherein each distal end of the two second support members are each independently coupled for pivot movement to a first side of a deck member having a first side, a second side, a proximal end, and a distal end, wherein the distal end of the deck member is coupled for pivot movement to the deck cavity or to the deck; and wherein the second side of the deck member becomes flush with the deck when the hide away helm is in the non-use position.

BRIEF DESCRIPTION OF THE DRAWINGS

Embodiments of the invention may be best understood by referring to the following description and accompanying drawings, which illustrate such embodiments. In the drawings.

Figure 1:
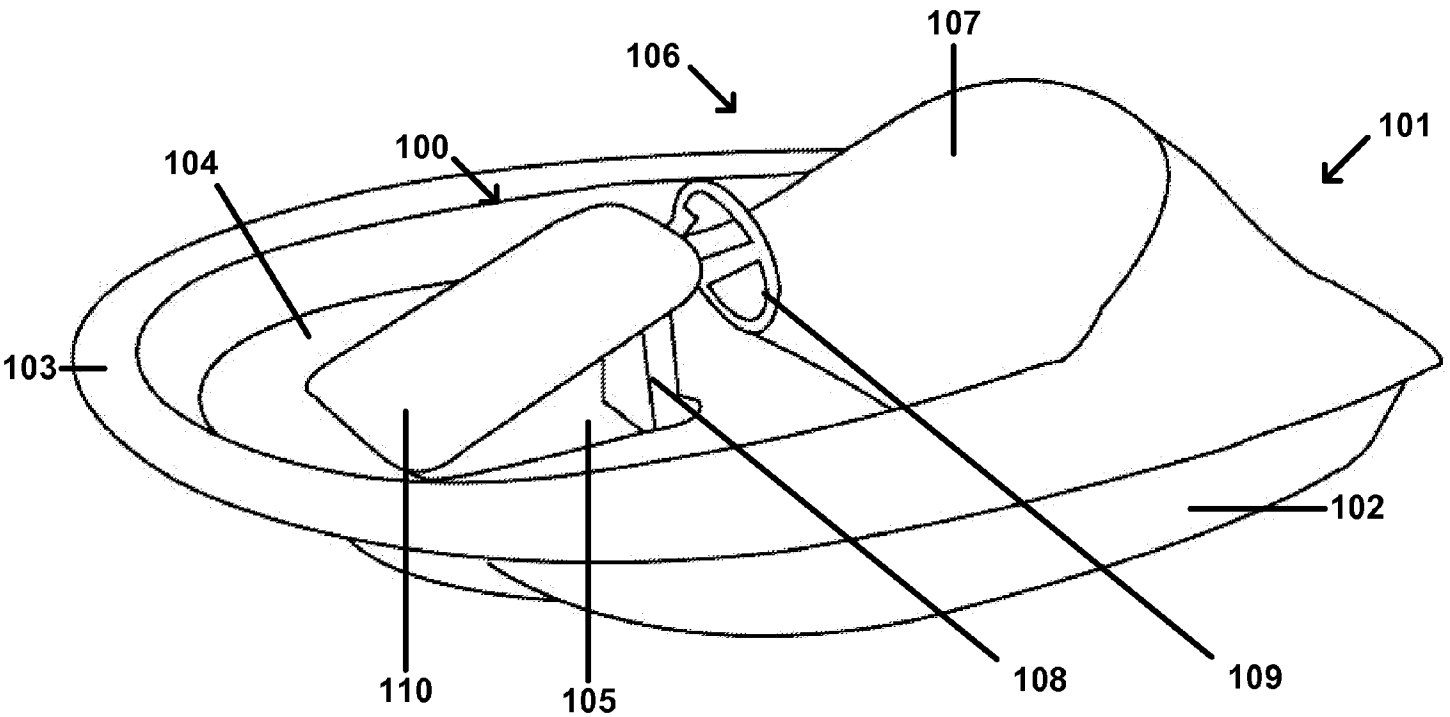
FIG. 1 is a perspective side-view drawing illustrating an exemplary hide away helm in a watercraft in the use position.

The drawings are not necessarily to scale. Like numbers used in the figures refer to like components, steps, and the like. However, it will be understood that the use of a number to refer to a component in a given figure is not intended to limit the component in another figure labeled with the same number.

DETAILED DESCRIPTION OF THE INVENTION

The present invention provides a hide away helm that extends into the interior space when the helm is in use but retracts under the deck when the helm is not in use. This hide away helm allows for the full use of the interior space of the boat when the helm is not in use, but is conveniently extends upward and into position in the interior of the boat before using. The hide away helm is simple to manufacture and install.

The following detailed description includes references to the accompanying drawings, which form a part of the detailed description. The drawings show, by way of illustration, specific embodiments in which the invention may be practiced. These embodiments, which are also referred to herein as "examples," are described in enough detail to enable those skilled in the art to practice the invention. The embodiments may be combined, other embodiments may be utilized, or structural, and logical changes may be made without departing from the scope of the present invention. The following detailed description is, therefore, not to be taken in a limiting sense, and the scope of the present invention is defined by the appended claims and their equivalents.

Before the present invention is described in such detail, however, it is to be understood that this invention is not limited to particular variations set forth and may, of course, vary. Various changes may be made to the invention described and equivalents may be substituted without departing from the true spirit and scope of the invention. In addition, many modifications may be made to adapt a particular situation, material, composition of matter, process, process act(s) or step(s), to the objective(s), spirit or scope of the present invention. All such modifications are intended to be within the scope of the claims made herein.

Methods recited herein may be carried out in any order of the recited events which is logically possible, as well as the recited order of events. Furthermore, where a range of values is provided, it is understood that every intervening value, between the upper and lower limit of that range and any other stated or intervening value in that stated range is encompassed within the invention. Also, it is contemplated that any optional feature of the inventive variations described may be set forth and claimed independently, or in combination with any one or more of the features described herein.

The referenced items are provided solely for their disclosure prior to the filing date of the present application. Nothing herein is to be construed as an admission that the present invention is not entitled to antedate such material by virtue of prior invention.

Unless otherwise indicated, the words and phrases presented in this document have their ordinary meanings to one of skill in the art. Such ordinary meanings can be obtained by reference to their use in the art and by reference to general and scientific dictionaries, for example, *Webster's Third New International Dictionary*, Merriam-Webster Inc., Springfield, Mass., 1993 and *The American Heritage Dictionary of the English Language*, Houghton Mifflin, Boston Mass., 1981.

References in the specification to "one embodiment" indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described.

The following explanations of certain terms are meant to be illustrative rather than exhaustive. These terms have their ordinary meanings given by usage in the art and in addition include the following explanations.

As used herein, the term "about" refers to a variation of 10 percent of the value specified; for example about 50 percent carries a variation from 45 to 55 percent.

As used herein, the term "and/or" refers to any one of the items, any combination of the items, or all of the items with which this term is associated.

As used herein, the singular forms "a," "an," and "the" include plural reference unless the context clearly dictates otherwise. It is further noted that the claims may be drafted to exclude any optional element. As such, this statement is intended to serve as antecedent basis for use of such exclusive terminology as "solely," "only," and the like in connection with the recitation of claim elements, or use of a "negative" limitation.

As used herein, the term "coupled" means the joining of two members directly or indirectly to one another. Such joining may be stationary in nature or movable in nature and/or such joining may allow for the flow of fluids, electricity, electrical signals, or other types of signals or communication between two members. Such joining may be achieved with the two members or the two members and any additional intermediate members being integrally formed as a single unitary body with one another or with the two members or the two members and any additional intermediate members being attached to one another. Such joining may be permanent in nature or alternatively may be removable or releasable in nature.

As used herein, the phrase "operatively coupled" refers to bringing two or more items together or into relationship with each other such that they may operate together or allow transfer of information between the two or more items.

As used herein, the term "cockpit" refers to the space on the deck where the user operates the helm.

As used herein, the term "deck" refers to the floor of a watercraft, especially the upper, open level extending for the full length of the vessel. The deck may be a one-piece molded construction.

As used herein, the term "gunnel" refers to the top edge of the side of the watercraft.

As used herein, the term "helm" refers to the steering mechanism of the watercraft.

As used herein, the terms "include," "for example," "such as," and the like are used illustratively and are not intended to limit the present invention.

As used herein, the terms "preferred" and "preferably" refer to embodiments of the invention that may afford certain benefits, under certain circumstances. However, other embodiments may also be preferred, under the same or other circumstances. Furthermore, the recitation of one or more preferred embodiments does not imply that other embodiments are not useful, and is not intended to exclude other embodiments from the scope of the invention.

As used herein, the term "watercraft" refers to a vessel for transport by water, constructed to provide buoyancy by excluding water and shaped to give stability and to allow propulsion. Also as used herein, the watercraft may include a molded hull and a molded deck. The molded deck may include a molded cockpit.

As used herein, the terms "front," "back," "rear," "upper," "lower," "right," and "left" in this description are merely used to identify the various elements as they are oriented in the FIGS, with "front," "back," and "rear" being relative apparatus. These terms are not meant to limit the element which they describe, as the various elements may be oriented differently in various applications.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element without departing from the teachings of the disclosure.

FIG. 1 is a perspective side-view drawing illustrating an exemplary hide away helm 100 in a watercraft 101 in the use position. The watercraft includes a hull 102, a bow 103, a deck 104, a deck cavity 105, and a cockpit 106 where the user (not shown) typically sits on the seat 107. In this view, the hide away helm 100 is in the use position and extends into the cockpit 106, where it can be operated by the user (not shown) in the seat 107. The hide away helm 100 includes a mounting member (not shown), a first support member 108, an optional biasing member (not shown), a steering wheel 109, two second support members (not shown), and a deck member 110 that extends up from the deck 104. To lower the hide away helm 100 from the use position, the user (not shown) would lift up on the end of the deck member 110 nearest the steering wheel 109, and gently push the steering wheel toward the bow 103 and the hide away helm 100 will retract into the deck cavity 105 and be covered up by the deck member 110.

Figure 2:
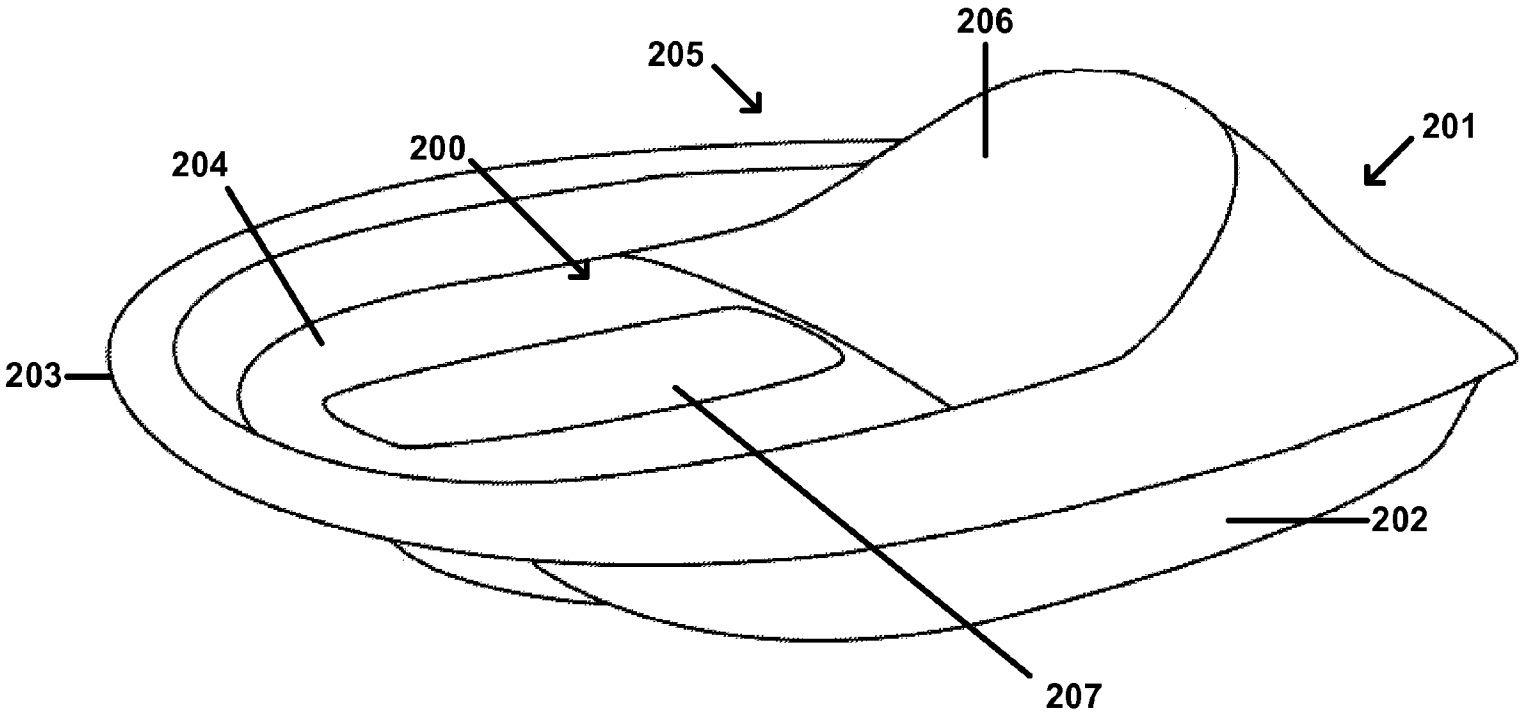
FIG. 2 is a perspective side-view drawing illustrating an exemplary hide away helm in a watercraft in the non-use use position.

FIG. 2 is a perspective side-view drawing illustrating an exemplary hide away helm 200 in a watercraft 201 in the non-use use position. The watercraft includes a hull 202, a bow 203, a deck 204, a deck cavity (not shown), and a cockpit 205 where the user (not shown) typically sits on the seat 206. In this view, the hide away helm 200 is in the non-use position and is retracted into the deck cavity, where it is covered by the deck member 207. To extend the hide away helm 200 from the non-use position, the user (not shown) would lift up on the end of the deck member 207 nearest the seat 206 and the hide away helm 200 will extend out of the deck cavity (not shown) into the use position.

Figure 3:
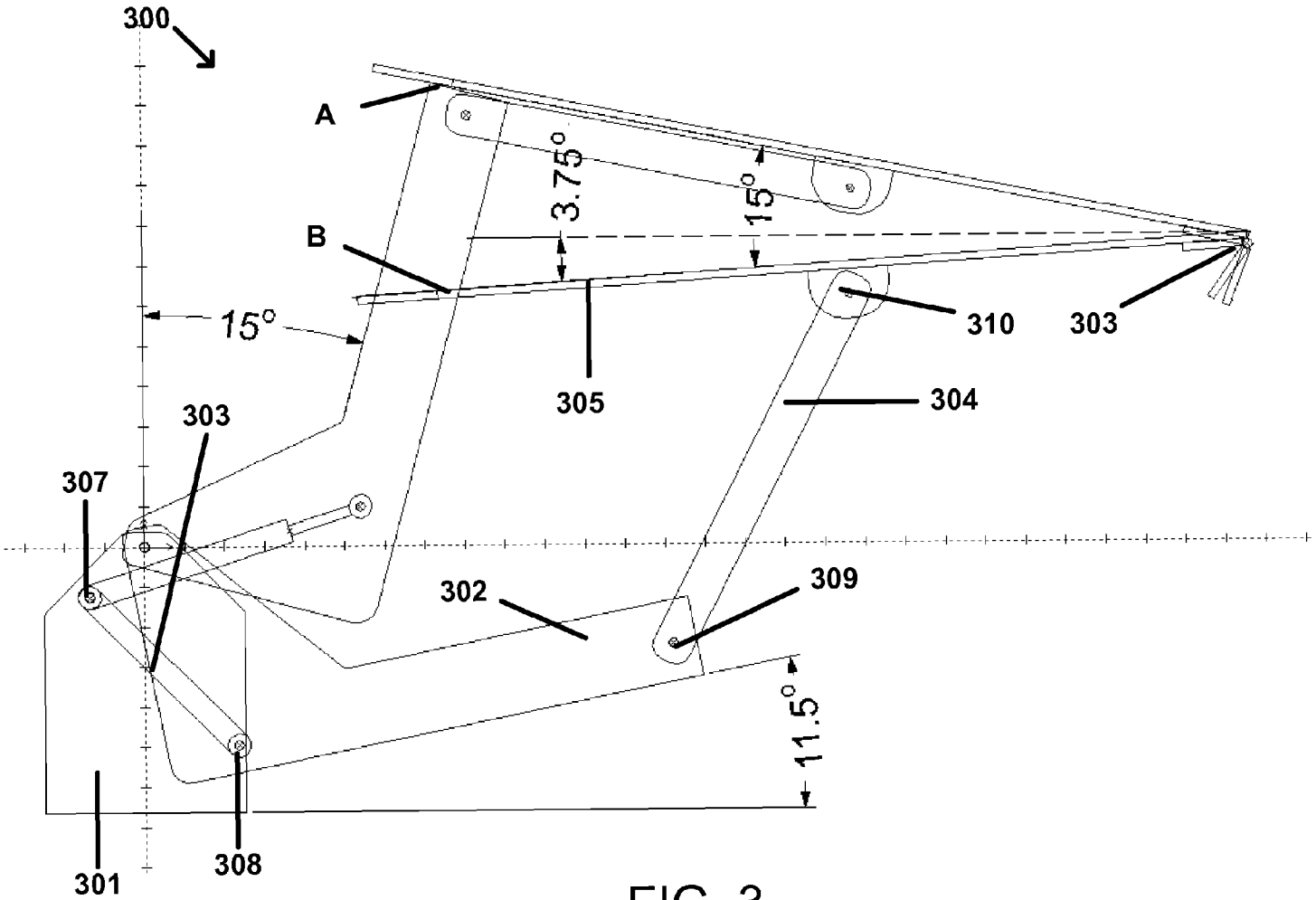
FIG. 3 is a side-view drawing illustrating an exemplary hide away helm in the extended use position and a partially retracted position.

FIG. 3 is a side-view drawing illustrating an exemplary hide away helm 300 in the extended use position (A) and a partially retracted position (B). The hide away helm 300 includes a mounting member 301, a first support member 302, an optional biasing member 303, a second support member 304, another second support member (not shown), a steering wheel (not shown), a deck member 305, and a hinge 306. The optional biasing member 303 is coupled for pivot movement to the mounting member 301 with a first connector 307 and to the first support member 302 with a second connector 308. The first support member 302 is coupled for pivot movement to the second support member 304 with a third connector 309 and to the deck member 305 with a fourth connector 310. To extend the hide away helm 300 from the non-use position (not shown), the user (not shown) would lift up on the end of the deck member 305 nearest the seat (not shown) and the hide away helm 300 will extend out of the deck cavity (not shown) into the partially retracted position (B) and then to the use position (A).

Figure 4:
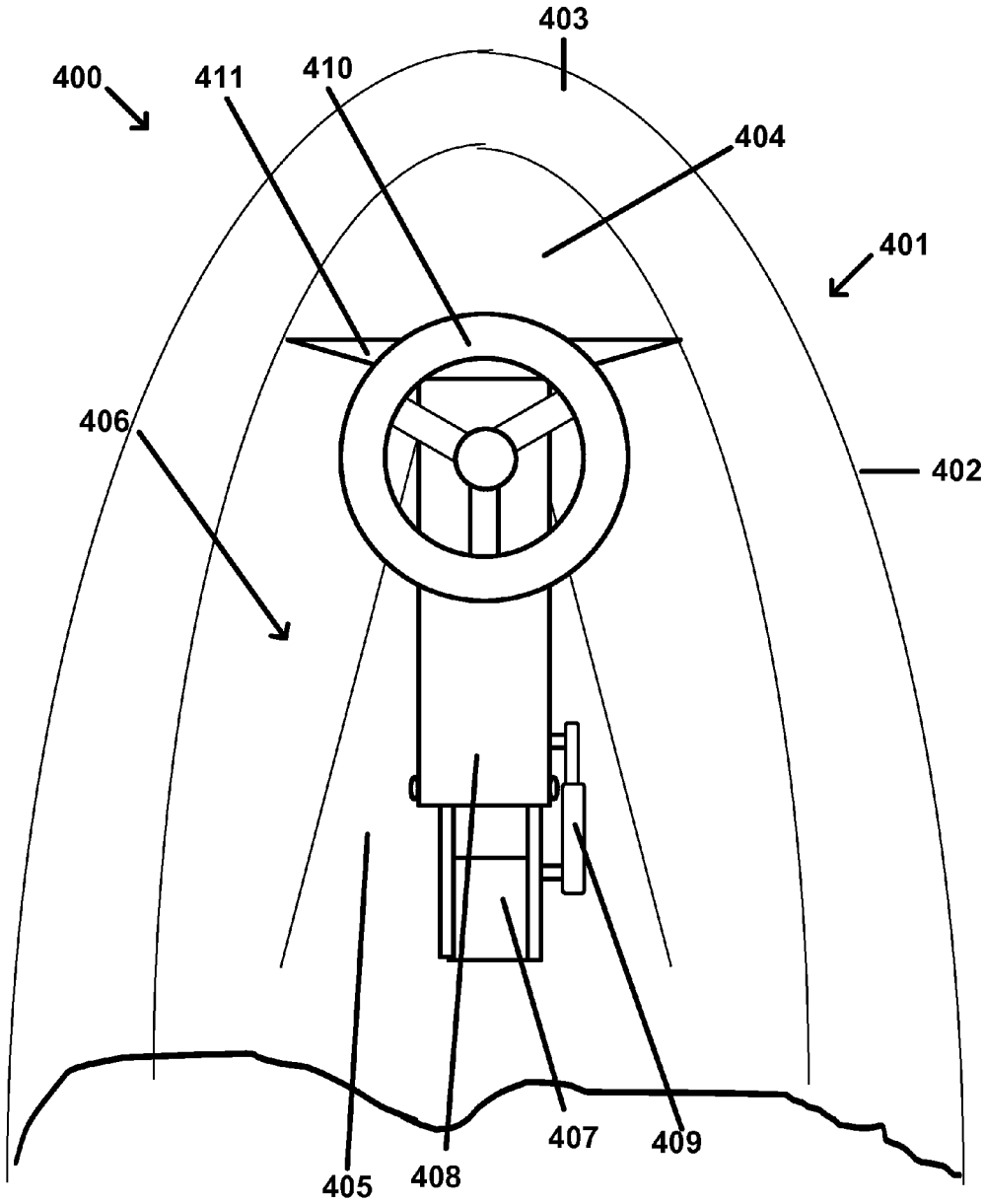
FIG. 4 is a perspective rear-view drawing illustrating an exemplary hide away helm in a watercraft in the use position.

FIG. 4 is a perspective rear-view drawing illustrating an exemplary hide away helm 400 in a watercraft 401 in the use position. The watercraft includes a hull 402, a bow 403, a deck 404, a deck cavity 405, and a cockpit 406. In this view, the hide away helm 400 is in the use position and extends into the cockpit 406, where it can be operated by the user (not shown) in the seat (not shown). The hide away helm 400 includes a mounting member 407, a first support member 408, an optional biasing member 409, a steering wheel 410, two second support members (not shown), and a deck member 411 that extends up from the deck 404. To lower the hide away helm 400 from the use position, the user (not shown) would lift up on the end of the deck member 411 nearest the steering wheel 410, and gently push the steering wheel 410 toward the bow 403 and the hide away helm 400 will retract into the deck cavity 405 and be covered up by the deck member 411.

In the claims provided herein, the steps specified to be taken in a claimed method or process may be carried out in any order without departing from the principles of the invention, except when a temporal or operational sequence is explicitly defined by claim language. Recitation in a claim to the effect that first a step is performed then several other steps are performed shall be taken to mean that the first step is performed before any of the other steps, but the other steps may be performed in any sequence unless a sequence is further specified within the other steps. For example, claim elements that recite "first A, then B, C, and D, and lastly E" shall be construed to mean step A must be first, step E must be last, but steps B, C, and D may be carried out in any sequence between steps A and E and the process of that sequence will still fall within the four corners of the claim.

Furthermore, in the claims provided herein, specified steps may be carried out concurrently unless explicit claim language requires that they be carried out separately or as parts of different processing operations. For example, a claimed step of doing X and a claimed step of doing Y may be conducted simultaneously within a single operation, and the resulting process will be covered by the claim. Thus, a step of doing X, a step of doing Y, and a step of doing Z may be conducted simultaneously within a single process step, or in two separate process steps, or in three separate process steps, and that process will still fall within the four corners of a claim that recites those three steps.

Similarly, except as explicitly required by claim language, a single substance or component may meet more than a single functional requirement, provided that the single substance fulfills the more than one functional requirement as specified by claim language.

All patents, patent applications, publications, scientific articles, web sites, and other documents and materials referenced or mentioned herein are indicative of the levels of skill of those skilled in the art to which the invention pertains, and each such referenced document and material is hereby incorporated by reference to the same extent as if it had been incorporated by reference in its entirety individually or set forth herein in its entirety. Additionally, all claims in this application, and all priority applications, including but not limited to original claims, are hereby incorporated in their entirety into, and form a part of, the written description of the invention.

Applicants reserve the right to physically incorporate into this specification any and all materials and information from any such patents, applications, publications, scientific articles, web sites, electronically available information, and other referenced materials or documents. Applicants reserve the right to physically incorporate into any part of this document, including any part of the written description, the claims referred to above including but not limited to any original claims.

What is claimed is:

1. A hide away helm for a watercraft that is positionable between a use position in which the hide away helm extends up from the deck and a non-use position in which the hide away helm retracts into a deck cavity and becomes flush with the deck, the hide away helm comprising:

a mounting member having a proximal end and one or more distal ends, wherein the proximal end of the mounting member is coupled to the deck cavity;

a first support member having a proximal end, a distal end, a first surface, and a second surface, wherein the proximal end of the first support member is coupled for pivot movement to the one or more distal ends of the mounting member;

an optional biasing member having a proximal end and a distal end, wherein the proximal end of the optional biasing member is coupled to the mounting member and the distal end of the optional biasing member is coupled to the first support member, wherein the optional biasing member biases the hide away helm into the non-use position;

a steering device operatively coupled to the first surface of the first support member;

one or more second support members each having a proximal and a distal end, wherein each proximal end of the one or more second support members are each independently coupled for pivot movement to the distal end of the first support member, wherein each distal end of the one or more second support members are each independently coupled for pivot movement to a first side of a deck member having a first side, a second side, a proximal end, and a distal end, wherein the distal end of the deck member is coupled for pivot movement to the deck cavity or to the deck; and wherein the second side of the deck member becomes flush with the deck when the hide away helm is in the non-use position.

2. The hide away helm of claim 1, wherein the deck comprises a cockpit.

3. The hide away helm of claim 2, wherein the hide away helm extends into the cockpit when in the use position.

4. The hide away helm of claim 1, wherein the steering device comprises a steering wheel.

5. The hide away helm of claim 1, wherein the optional biasing member comprises a gas strut.

6. A hide away helm for a watercraft that is positionable between a use position in which the hide away helm extends up from the deck and a non-use position in which the hide away helm retracts into a deck cavity and becomes flush with the deck, the hide away helm comprising:

a mounting member having a proximal end and one or more distal ends, wherein the proximal end of the mounting member is coupled to the deck cavity;

a first support member having a proximal end, a distal end, a first surface, and a second surface, wherein the proximal end of the first support member is coupled for pivot movement to the one or more distal ends of the mounting member;

a biasing member having a proximal end and a distal end, wherein the proximal end of the biasing member is coupled to the mounting member and the distal end of the biasing member is coupled to the first support member, wherein the biasing member biases the hide away helm into the non-use position;

a steering device operatively coupled to the first surface of the first support member;

two second support members each having a proximal and a distal end, wherein each proximal end of the two second support members are each independently coupled for pivot movement to the distal end of the first support member, wherein each distal end of the two second support members are each independently coupled for pivot movement to a first side of a deck member having a first side, a second side, a proximal end, and a distal end, wherein the distal end of the deck member is coupled for pivot movement to the deck cavity or to the deck; and wherein the second side of the deck member becomes flush with the deck when the hide away helm is in the non-use position.

7. The hide away helm of claim 6, wherein the deck comprises a cockpit.

8. The hide away helm of claim 7, wherein the hide away helm extends into the cockpit when in the use position.

9. The hide away helm of claim 6, wherein the steering device comprises a steering wheel.

10. The hide away helm of claim 6, wherein the biasing member comprises a gas strut.

11. A hide away helm for a watercraft that is positionable between a use position in which the hide away helm extends up from the deck and a non-use position in which the hide away helm retracts into a deck cavity and becomes flush with the deck, the hide away helm comprising:

a mounting member having a proximal end and one or more distal ends, wherein the proximal end of the mounting member is coupled to the deck cavity;

a first support member having a proximal end, a distal end, a first surface, and a second surface, wherein the proximal end of the first support member is coupled for pivot movement to the one or more distal ends of the mounting member;

a biasing member having a proximal end and a distal end, wherein the proximal end of the biasing member is coupled to the mounting member and the distal end of the biasing member is coupled to the first support member, wherein the biasing member comprises a gas strut, wherein the biasing member biases the hide away helm into the non-use position;

a steering device operatively coupled to the first surface of the first support member, wherein the steering device comprises a steering wheel;

two second support members each having a proximal and a distal end, wherein each proximal end of the two second support members are each independently coupled for pivot movement to the distal end of the first support member, wherein each distal end of the two second support members are each independently coupled for pivot movement to a first side of a deck member having a first side, a second side, a proximal end, and a distal end, wherein the distal end of the deck member is coupled for pivot movement to the deck cavity or to the deck; and wherein the second side of the deck member becomes flush with the deck when the hide away helm is in the non-use position.

* * * * *